US010109234B2

(12) United States Patent
Sun et al.

(10) Patent No.: US 10,109,234 B2
(45) Date of Patent: Oct. 23, 2018

(54) DRIVE CIRCUIT AND DRIVE METHOD THEREOF, DISPLAY SUBSTRATE AND DRIVE METHOD THEREOF, AND DISPLAY DEVICE

(71) Applicant: BOE Technology Group Co., Ltd., Beijing (CN)

(72) Inventors: Tuo Sun, Beijing (CN); Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/511,748

(22) PCT Filed: Apr. 7, 2016

(86) PCT No.: PCT/CN2016/078669

§ 371 (c)(1),
(2) Date: Mar. 16, 2017

(87) PCT Pub. No.: WO2016/180110

PCT Pub. Date: Nov. 17, 2016

(65) Prior Publication Data

US 2017/0294161 A1 Oct. 12, 2017

(30) Foreign Application Priority Data

May 11, 2015 (CN) ..... 2015 1 0236358

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0871* (2013.01);
(Continued)

(58) Field of Classification Search
None
See application file for complete search history.

(56) References Cited

U.S. PATENT DOCUMENTS 7,843,442 B2 11/2010 Choi et al.
8,982,196 B2 3/2015 Jung
(Continued)

FOREIGN PATENT DOCUMENTS

CN 1573885 A 2/2005
CN 1835059 A 9/2006
(Continued)

OTHER PUBLICATIONS

International Search Report (English translation) and Written Opinion of International Application No. PCT/CN2016/078669, dated Jul. 1, 2016, 17 pages.
(Continued)

*Primary Examiner* — Nicholas Lee
(74) *Attorney, Agent, or Firm* — Westman, Champlin & Koehler, P.A.

(57) ABSTRACT

Embodiments of the present disclosure provide a drive circuit and a drive method thereof, a display substrate and a drive method thereof, and a display device. The drive circuit comprises a conversion unit provided with a first input terminal, a second input terminal, a third input terminal, a fourth input terminal, and an output terminal, wherein the fourth input terminal is connected to a direct current power source, and wherein the output terminal is connected to a pixel circuit. The first input terminal is configured to input a voltage signal, the second input terminal is configured to input a first drive signal, the third input terminal is configured to input a second drive signal, and the output terminal is configured to output a current signal. The conversion unit converts the voltage signal output from the source drive unit
(Continued)

into the current signal and the pixel circuit is driven by the current signal.

8 Claims, 6 Drawing Sheets

(52) U.S. Cl.
CPC ..... *G09G 2320/0233* (2013.01); *G09G 2330/021* (2013.01)

(56) References Cited

U.S. PATENT DOCUMENTS

| | | | |
|---|---|---|---|
| 9,093,030 | B2 | 7/2015 | Liang et al. |
| 2003/0030382 | A1 | 2/2003 | Koyama |
| 2004/0207579 | A1 | 10/2004 | Matsumoto |
| 2004/0233142 | A1 | 11/2004 | Matsumoto et al. |

FOREIGN PATENT DOCUMENTS

| | | | |
|---|---|---|---|
| CN | 1912978 | A | 2/2007 |
| CN | 101819536 | A | 9/2010 |
| CN | 102034449 | A | 4/2011 |
| CN | 202067514 | U | 12/2011 |
| CN | 102646388 | A | 8/2012 |
| CN | 104778926 | A | 7/2015 |
| KR | 10-2008-0040845 | A | 5/2008 |

OTHER PUBLICATIONS

English translation of Box No. V of the Written Opinion for the International Searching Authority for International Application No. PCT/CN2016/078669, 2 pages.

First Office Action, including Search Report, for Chinese Patent Application No. 201510236358.9, dated Nov. 27, 2015, 7 pages.

Search Report from Chinese Patent Application No. 201510236358.9 dated Sep. 7, 2015, 11 pages.

DRIVE CIRCUIT AND DRIVE METHOD THEREOF, DISPLAY SUBSTRATE AND DRIVE METHOD THEREOF, AND DISPLAY DEVICE

CROSS-REFERENCE TO RELATED APPLICATION(S)

This application is a U.S. National Phase Application of International Application No. PCT/CN2016/078669, filed on Apr. 7, 2016, entitled "DRIVE CIRCUIT AND DRIVE METHOD THEREFOR, DISPLAY SUBSTRATE AND DRIVE METHOD THEREFOR, AND DISPLAY DEVICE," which claims priority to Chinese Application No. 201510236358.9, filed on May 11, 2015, both of which are incorporated herein by reference in their entireties.

TECHNICAL FIELD

The present disclosure relates to the field of display technology, and in particular, to a drive circuit and a drive method thereof, a display substrate and a drive method thereof, and a display device.

BACKGROUND

In an existing drive method of an Active-Matrix Organic Light Emitting Diode (AMOLED), a data voltage is output by a drive circuit and written into a pixel circuit directly to control luminance of pixels. However, with the improvement of the performance of light emitting devices and resolutions of display panels, differences between data voltages corresponding to neighboring grey scales become smaller, so that the requirements of output accuracy of a drive circuit is increasingly higher. In this case, a drive circuit in the prior art has relatively low output accuracy, relatively high power consumption, and poor uniformity.

SUMMARY

In order to at least partially solve the above-mentioned problems, embodiments of the present disclosure provide a drive circuit and a drive method thereof, a display substrate and a drive method thereof, and a display device for at least partially solving the problem that the output accuracy of the drive circuit in the prior art is low, its power consumption is high and its uniformity is poor.

An embodiment of the present disclosure provides a drive circuit comprising a conversion unit provided with a first input terminal, a second input terminal, a third input terminal, a fourth input terminal, and an output terminal, wherein the fourth input terminal is connected to a direct current power source, and wherein the output terminal is connected to a pixel circuit;

wherein the first input terminal is configured to input a voltage signal, the second input terminal is configured to input a first drive signal, the third input terminal is configured to input a second drive signal, the output terminal is configured to output a current signal, and the conversion unit is configured to convert the voltage signal into the current signal.

The conversion unit may comprise a first transistor, a second transistor, a third transistor, and a first capacitor;

wherein the first transistor has a gate connected to the second input terminal, a first electrode connected to the first input terminal, and a second electrode connected to a gate of the second transistor;

wherein the second transistor has a first electrode connected to the fourth input terminal and a second electrode connected to a first electrode of the third transistor;

wherein the third transistor has a gate connected to the third input terminal and a second electrode connected to the output terminal;

wherein the first capacitor is connected in parallel between the gate and the first electrode of the second transistor, wherein a first electrode is one of source and drain of a transistor and a second electrode is the other of source and drain of the transistor.

The drive circuit may further comprise a source drive unit connected to the first input terminal and configured to output the voltage signal.

The first transistor, the second transistor, and the third transistor may be set in a first mode where the first transistor, the second transistor, and the third transistor are all set as N-type transistors, or a second mode where the first transistor, the second transistor, and the third transistor are all set as P-type transistors.

An embodiment of the present disclosure further provides a drive method of a drive circuit which comprises any of the above-mentioned drive circuits, the drive method comprising phase 1 through phase 3, when the drive circuit is set in the first mode, the drive method comprising:

at phase 1, inputting a high level signal into the first input terminal, inputting a high level signal into the second input terminal, and inputting a low level signal into the third input terminal;

at phase 2, inputting a low level signal into the first input terminal, inputting a low level signal into the second input terminal, and inputting a high level signal into the third input terminal;

at phase 3, inputting a high level signal into the first input terminal, inputting a low level signal into the second input terminal, and inputting a low level signal into the third input terminal.

when the drive circuit is set in the second mode, the drive method comprising:

at phase 1, inputting a high level signal into the first input terminal, inputting a low level signal into the second input terminal, and inputting a high level signal into the third input terminal.

at phase 2, inputting a low level signal into the first input terminal, inputting a high level signal into the second input terminal, and inputting a low level signal into the third input terminal;

at phase 3, inputting a high level signal into the first input terminal, inputting a high level signal into the second input terminal, and inputting a high level signal into the third input terminal.

An embodiment of the present disclosure further provides a display substrate comprising a pixel circuit and any of the above-mentioned drive circuits, the pixel circuit being provided with a fifth input terminal, a sixth input terminal, a seventh input terminal and an eighth input terminal, wherein the fifth input terminal is connected to the output terminal;

wherein the fifth input terminal is configured to input the current signal, the sixth input terminal is configured to input a scanning signal, the seventh input terminal is configured to input a high level signal, and the eighth input terminal is configured to input a low level signal.

The pixel circuit may comprise a fourth transistor, a fifth transistor, a sixth transistor, a seventh transistor, a second capacitor and a light emitting device;

wherein the fourth transistor has a gate connected to the sixth input terminal, a first electrode connected to the fifth input terminal, and a second electrode connected to a first node in the pixel circuit;

wherein the fifth transistor has a gate connected to the sixth input terminal, a first electrode connected to the fifth input terminal, and a second electrode connected to a second node in the pixel circuit;

wherein the sixth transistor has a gate connected to the first node, a first electrode connected to the second node, and a second electrode connected to a positive electrode of the light emitting device;

wherein the seventh transistor has a gate connected to the first node, a first electrode connected to the second node, and a second electrode connected to the seventh input terminal;

wherein the second capacitor is connected in parallel between the gate and the second electrode of the seventh transistor;

wherein the light emitting device has a negative electrode connected to the eighth input terminal, wherein a first electrode is one of source and drain of a transistor and a second electrode is the other of source and drain of the transistor.

In the first mode, the first transistor, the second transistor, and the third transistor are set as N-type transistors, and the fourth transistor, the fifth transistor, the sixth transistor, and the seventh transistor are all set as P-type transistors; and in the second mode, the first transistor, the second transistor, and the third transistor are set as P-type transistors, and the fourth transistor, the fifth transistor, the sixth transistor, and the seventh transistor are all set as N-type transistors.

The conversion unit may be provided at the end of the fan-out structure of the display panel; or the conversion unit may be provided between the output terminal of the source drive unit and a bonding area of the display panel.

An embodiment of the present disclosure further provides a drive method of a display substrate which comprises any of the above-mentioned drive circuits, the drive method comprising first through third phases, when the drive circuit is set in the first mode, the drive method comprising:

at phase 1, inputting a high level signal into the first input terminal, inputting a high level signal into the second input terminal, inputting a low level signal into the third input terminal, and inputting a high level signal into the sixth input terminal;

at phase 2, inputting a low level signal into the first input terminal, inputting a low level signal into the second input terminal, inputting a high level signal into the third input terminal, and inputting a low level signal into the sixth input terminal;

at phase 3, inputting a high level signal into the first input terminal, inputting a low level signal into the second input terminal, inputting a low level signal into the third input terminal, and inputting a high level signal into the sixth input terminal;

when the drive circuit is set in the second mode, the drive method comprising:

at phase 1, inputting a high level signal into the first input terminal, inputting a low level signal into the second input terminal, inputting a high level signal into the third input terminal, and inputting a low level signal into the sixth input terminal;

at phase 2, inputting a low level signal into the first input terminal, inputting a high level signal into the second input terminal, inputting a low level signal into the third input terminal, and inputting a high level signal into the sixth input terminal;

at phase 3, inputting a high level signal into the first input terminal, inputting a high level signal into the second input terminal, inputting a high level signal into the third input terminal, and inputting a low level signal into the sixth input terminal.

Embodiments of the present disclosure provide a display device comprising any of the above mentioned display substrate.

DETAILED DESCRIPTION

In order to make one skilled in the art understand the technical solutions of the present disclosure in a better way, detailed descriptions of a drive circuit and a drive method thereof, a display substrate and a drive method thereof, and a display device according to the present disclosure will be given below with reference to the drawings and specific embodiments.

First Embodiment

Figure 1:
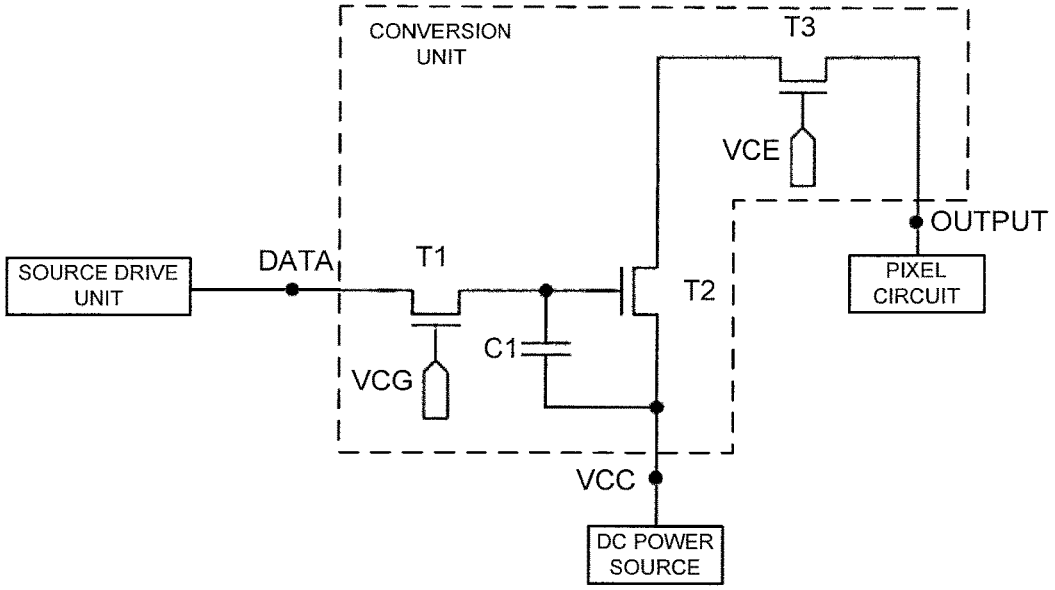
FIG. 1 is a diagram showing a structure of a drive circuit according to a first embodiment of the present disclosure.

FIG. 1 is a diagram showing a structure of a drive circuit according to a first embodiment of the present disclosure. As shown in FIG. 1, the drive circuit comprises a conversion unit and a source drive unit, and the conversion unit is provided with a first input terminal "DATA", a second input terminal "VCG", a third input terminal "VCE", a fourth input terminal "VCC", and an output terminal "OUTPUT", wherein the first input terminal "DATA" is connected to the source drive unit, wherein the fourth input terminal "VCC" is connected to a direct current power source), and wherein the output terminal "OUTPUT" is connected to a pixel circuit. Optionally, the current input to the fourth input terminal "VCC" comes from the direct current power source of the display panel. Because the load of the drive circuit is low, the power consumption of the drive circuit which is supplied by the direct current power source is low.

In the present embodiment, the source drive unit is configured to output a voltage signal, and the conversion unit is configured to convert the voltage signal into a corresponding current signal. To be more specific, the first input terminal "DATA" of the conversion unit is configured to provide the voltage signal output from the source drive unit to the conversion unit, the second input terminal "VCG" is configured to input a first drive signal, the third input terminal "VCE" is configured to input a second drive signal, and the output terminal "OUTPUT" is configured to output a converted current signal to the pixel circuit. The conversion unit converts the voltage signal output from the source drive unit into the current signal and the pixel circuit is driven by the current signal. The technical solution according to the present embodiment makes the drive circuit have a high output accuracy and a low power consumption, and can also improve the uniformity of images displayed by the display panel and increase the dynamic range of the display panel.

With reference to FIG. 1, the conversion unit includes a first transistor T1, a second transistor T2, a third transistor T3, and a first capacitor C1, wherein the first transistor T1, the second transistor T2, and the third transistor T3 are N-type transistors. In the following description, since source and drain of a transistor can be used interchangeably, one of the source and the drain is referred to as a first electrode, and the other of the source and the drain is referred to as a second electrode. To be more specific, the first transistor T1 has a gate connected to the second input terminal "VCG", a first electrode connected to the first input terminal "DATA", and a second electrode connected to a gate of the second transistor T2. The second transistor T2 has a first electrode connected to the fourth input terminal "VCC" and a second electrode connected to a first electrode of the third transistor T3. The third transistor T3 has a gate connected to the third input terminal "VCE" and a second electrode connected to the output terminal "OUTPUT". The first capacitor C1 is connected in parallel between the gate and the first electrode of the second transistor T2. In practical applications, the conversion unit may be provided at the end of the fan-out structure of the display panel. Optionally, the conversion unit is provided between the output terminal of the source drive unit and a bonding area of the display panel.

In the drive circuit according to the present embodiment, the conversion unit converts the voltage signal output from the source drive unit into the current signal and the pixel circuit is driven by the current signal. The technical solution according to the present embodiment makes the drive circuit have a high output accuracy and a low power consumption, and can also improve the uniformity of images displayed by the display panel and increase the dynamic range of the display panel.

Second Embodiment

Figure 2:
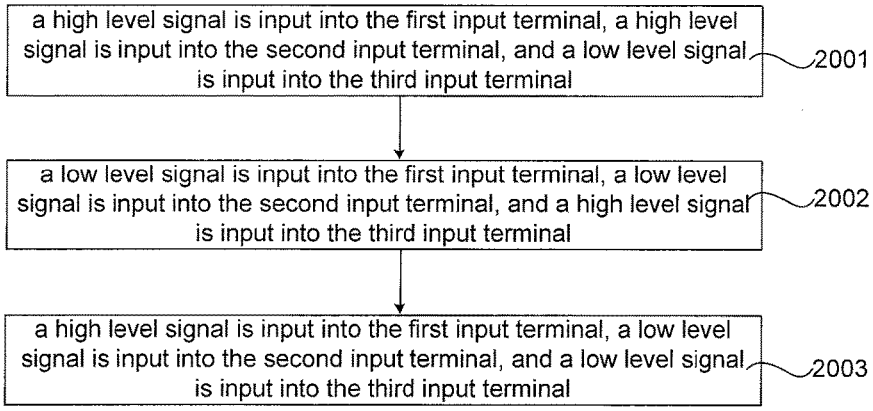
FIG. 2 is a flow chart showing a drive method of a drive circuit according to a second embodiment of the present disclosure.
Figure 3:
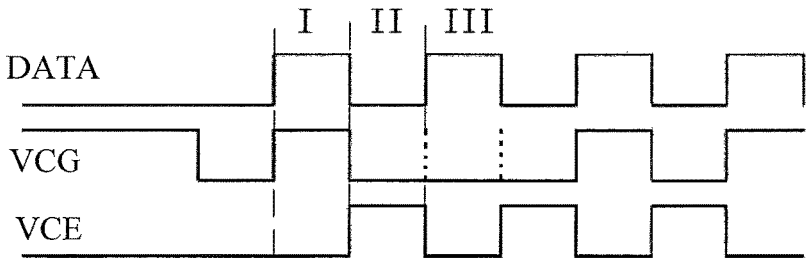
FIG. 3 is a timing chart of the operation of the drive circuit corresponding to the drive method according to the second embodiment of the present disclosure.

FIG. 2 is a flow chart showing a drive method of a drive circuit according to a second embodiment of the present disclosure, and FIG. 3 is a timing chart of the operation of the drive circuit corresponding to the drive method. The drive circuit may comprise the drive circuit according to the first embodiment, detailed description thereof is given as above, and thus detailed description thereof may be omitted for simplicity. Taking the drive circuit according to the first embodiment as an example, a detailed description of the drive method of the drive circuit according to the present embodiment will be given below with reference to FIG. 1-FIG. 3. As shown in FIG. 2, the drive method comprises steps 2001 through 2003 as follows.

At step 2001, a high level signal is input into the first input terminal, a high level signal is input into the second input terminal, and a low level signal is input into the third input terminal. This step corresponds to the first phase I in the timing chart of the operations shown in FIG. 3.

In the present embodiment, the first phase I is a charging phase for the conversion unit. As shown in FIG. 3, the voltage signal input into the first input terminal "DATA" of the conversion unit is a high level signal, and the first drive signal input into the second input terminal "VCG" is also a high level signal. At this time, the first transistor T1 and the second transistor T2 are turned on, and the first capacitor C1 is charged by the voltage signal. At this time, the voltage signal charged into the first capacitor C1 is just the data signal needed by the pixel circuit corresponding to the drive circuit. In addition, the second drive signal input into the third input terminal "VCE" of the conversion unit is a low level signal, such that the third transistor T3 is turned off, and therefore the output terminal "OUTPUT" of the conversion unit does not output the current signal.

At step 2002, a low level signal is input into the first input terminal, a low level signal is input into the second input terminal, and a high level signal is input into the third input terminal. This step corresponds to the second phase II in the timing chart of the operations shown in FIG. 3.

In the present embodiment, the second phase II is a charging phase for the pixel circuit corresponding to the drive circuit. As shown in FIG. 3, the voltage signal input into the first input terminal "DATA" of the conversion unit is a low level signal, and the first drive signal input into the second input terminal "VCG" is also a low level signal. At this time, the first transistor T1 is turned off and the second transistor T2 is turned on. In addition, the second drive signal input into the third input terminal "VCE" of the conversion unit is a high level signal, such that the third transistor T3 is turned on, and therefore the output terminal "OUTPUT" of the conversion unit outputs the current signal. At this time, the second transistor T2 and the third transistor T3 are turned on simultaneously, and the second transistor T2 controls the current of the whole charging path. The current signal $I_{signal}$ is:

$$I_{signal} = \frac{1}{2}\mu_n \cdot C \cdot \frac{W}{L} \cdot (Vgs - Vth)^2$$

where $\mu_n$ is the carrier mobility, C is the capacitance per unit area for the gate insulation layer, W/L is the width to length ratio of the second transistor T2, $V_{gs}$ is the gate-source voltage of the second transistor T2, and $V_{th}$ is the threshold voltage of the second transistor T2. In the present embodiment, the source of the second transistor T2 is the first electrode, the gate-source voltage of the second transistor T2 is $V_{gs}=V_{data}-V_{CC}$, wherein $V_{data}$ is the voltage input into the first input terminal "DATA" of the conversion unit, and $V_{CC}$ is the voltage input into the fourth input terminal "VCC". At this time, the voltage signal $V_{data}$ is converted into $I_{signal}$, and $I_{signal}$ is output to the corresponding pixel circuit.

In the drive method of the drive circuit according to the present embodiment, the process of converting the voltage signal output from the source drive unit (i.e. the voltage signal input into the first input terminal "DATA" of the conversion unit), $V_{data}$, into the current signal, $I_{signal}$, occurs in the first phase I and the second phase II.

At step 2003, a high level signal is input into the first input terminal, a low level signal is input into the second input terminal, and a low level signal is input into the third input terminal. This step corresponds to the third phase III in the timing chart of the operations shown in FIG. 3.

In the present embodiment, the third phase III is a light emitting phase for the pixel circuit corresponding to the drive circuit. As shown in FIG. 3, the voltage signal input into the first input terminal "DATA" of the conversion unit is a high level signal, and the first drive signal input into the second input terminal "VCG" is a low level signal. At this time, the first transistor T1 and the second transistor T2 are turned off. In addition, the second drive signal input into the third input terminal "VCE" of the conversion unit is a low level signal, such that the third transistor T3 is turned off, and therefore the output terminal "OUTPUT" of the conversion unit does not output the current signal.

In the drive method of the drive circuit according to the present embodiment, the conversion unit converts the voltage signal output from the source drive unit into the current signal and the pixel circuit is driven by the current signal. The technical solution according to the present embodiment makes the drive circuit have a high output accuracy and a low power consumption, and can also improve the uniformity of images displayed by the display panel and increase the dynamic range of the display panel.

Third Embodiment

Figure 4:
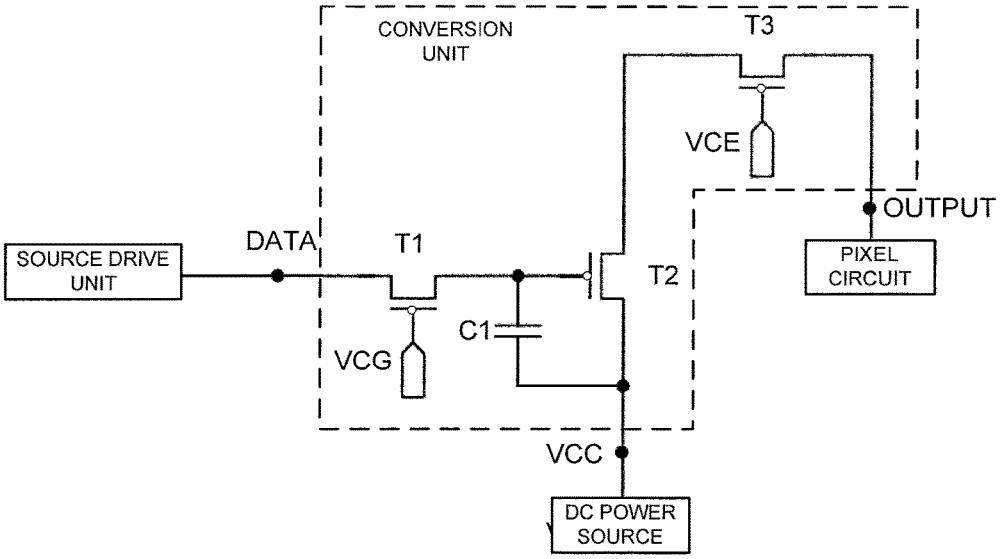
FIG. 4 is a diagram showing a structure of a drive circuit according to a third embodiment of the present disclosure.

FIG. 4 is a diagram showing a structure of a drive circuit according to a third embodiment of the present disclosure. As shown in FIG. 4, the drive circuit comprises a conversion unit and a source drive unit, and the conversion unit is provided with a first input terminal "DATA", a second input terminal "VCG", a third input terminal "VCE", a fourth input terminal "VCC", and an output terminal "OUTPUT", wherein the first input terminal "DATA" is connected to the source drive unit, wherein the fourth input terminal "VCC" is connected to a direct current power source, and wherein the output terminal "OUTPUT" is connected to a pixel circuit. The conversion unit comprises a first transistor T1, a second transistor T2, a third transistor T3, and a first capacitor C1. In the following description, since source and drain of a transistor can be used interchangeably, one of the source and the drain is referred to as a first electrode, and the other of the source and the drain is referred to as a second electrode. The first transistor T1 has a gate connected to the second input terminal "VCG", a first electrode connected to the first input terminal "DATA", and a second electrode connected to a gate of the second transistor T2. The second transistor T2 has a first electrode connected to the fourth input terminal "VCC" and a second electrode connected to a first electrode of the third transistor T3. The third transistor T3 has a gate connected to the third input terminal "VCE" and a second electrode connected to the output terminal "OUTPUT". The first capacitor C1 is connected in parallel between the gate and the first electrode of the second transistor T2.

The drive circuit according to the present embodiment differs from the drive circuit according to the first embodiment in that the first transistor T1 through the third transistor T3 in the drive circuit according to the first embodiment are all N-type transistors, whereas the first transistor T1 through the third transistor T3 in the drive circuit according to the present embodiment are all P-type transistors. Accordingly, when a drive method similar to that according to the second embodiment is used to drive the drive circuit according to the present embodiment, at respective phases, the signals of high levels input at the second and third input terminals are changed to signals of low levels, and the signals of low levels input at the second and third input terminals are changed to signal of high levels.

In the drive circuit according to the present embodiment, the conversion unit converts the voltage signal output from the source drive unit into the current signal and the pixel circuit is driven by the current signal. The technical solution according to the present embodiment makes the drive circuit have a high output accuracy and a low power consumption, and can also improve the uniformity of images displayed by the display panel and increase the dynamic range of the display panel.

Fourth Embodiment

Figure 5:
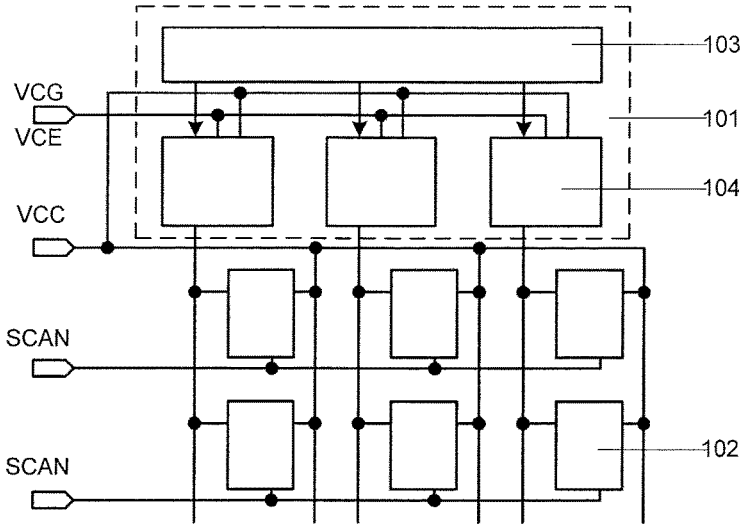
FIG. 5 is a diagram showing structures of a drive circuit and a pixel circuit in a display substrate according to a fourth embodiment of the present disclosure.
Figure 6:
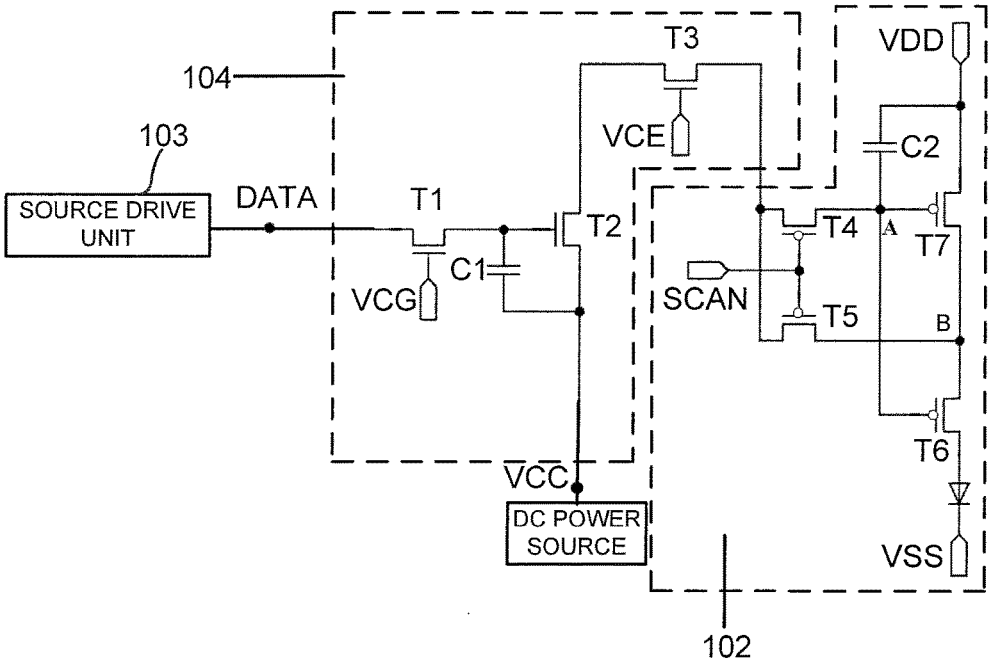
FIG. 6 is a diagram showing specific structures of a drive circuit and a pixel circuit in a display substrate according to a fourth embodiment of the present disclosure.

The present embodiment provides a display substrate comprising a drive circuit and a pixel circuit. FIG. 5 is a diagram showing structures of a drive circuit and a pixel circuit in a display substrate according to the present embodiment, and FIG. 6 is a diagram showing specific structures of the drive circuit and the pixel circuit in the display substrate according to the present embodiment. As shown in FIG. 5 and FIG. 6, the display substrate comprises a driving circuit 101 and a pixel circuit 102, and the driving circuit 101 comprises a source drive unit 103 and a conversion unit 104. The number of the conversion units 104 may be plural. The display substrate according to the present embodiment is provided with three conversion units 104 connected side by side.

As shown in FIG. 6, the conversion unit 104 is provided with a first input terminal "DATA", a second input terminal "VCG", a third input terminal "VCE", a fourth input terminal "VCC", and an output terminal "OUTPUT", wherein the first input terminal "DATA" is connected to the source drive unit 103, wherein the fourth input terminal "VCC" is connected to a direct current power source, and wherein the output terminal "OUTPUT" is connected to a pixel circuit 102. The first input terminal "DATA" is configured to provide the voltage signal output from the source drive unit 103 to the conversion unit 104, the second input terminal "VCG" is configured to input a first drive signal, the third input terminal "VCE" is configured to input a second drive signal, and the output terminal "OUTPUT" is configured to output a converted current signal to the pixel circuit 102. The conversion unit 104 converts the voltage signal output from the source drive unit 103 into the current signal and the pixel circuit 102 is driven by the current signal. The technical solution according to the present embodiment makes the drive circuit 101 have a high output accuracy and a low power consumption, and can also improve the uniformity of images displayed by the display panel and increase the dynamic range of the display panel.

With reference to FIG. 6, the conversion unit 104 includes a first transistor T1, a second transistor T2, a third transistor T3, and a first capacitor C1, wherein the first transistor T1, the second transistor T2, and the third transistor T3 are N-type transistors. To be more specific, the first transistor T1 has a gate connected to the second input terminal "VCG" of the conversion unit 104, a first electrode connected to the first input terminal "DATA", and a second electrode connected to a gate of the second transistor T2. The second transistor T2 has a first electrode connected to the fourth input terminal "VCC" and a second electrode connected to a first electrode of the third transistor T3. The third transistor T3 has a gate connected to the third input terminal "VCE" of the conversion unit 104 and a second electrode connected to the output terminal "OUTPUT" of the conversion unit 104. The first capacitor C1 is connected in parallel between the gate and the first electrode of the second transistor T2.

The pixel circuit 102 is provided with a fifth input terminal, a sixth input terminal "SCAN", and seventh input terminal "VDD", and an eighth input terminal "VSS", wherein the fifth input terminal is connected to the output terminal "OUTPUT" of the conversion unit 104. The fifth input terminal is configured to input the current signal acquired through the conversion unit 104, the sixth input terminal "SCAN" is configured to input a scanning signal, the seventh input terminal "VDD" is configured to input a high level signal, and the eighth input terminal "VSS" is configured to input a low level signal.

With reference to FIG. 6, the pixel circuit 102 comprises a fourth transistor T4, a fifth transistor T5, a sixth transistor T6, a seventh transistor T7, a second capacitor C2 and a light emitting device, wherein the fourth transistor T4, the fifth transistor T5, the sixth transistor T6, and the seventh transistor T7 are P-type transistors. The fourth transistor T4, the fifth transistor T5, the sixth transistor T6, the seventh transistor T7, and the second capacitor C2 constitute a current mirror pixel circuit. In the following description, since source and drain of a transistor can be used interchangeably, one of the source and the drain is referred to as a first electrode, and the other of the source and the drain is referred to as a second electrode. To be specific, the fourth transistor T4 has a gate connected to the sixth input terminal "SCAN" of the pixel circuit 102, a first electrode connected to the fifth input terminal, and a second electrode connected to a first node "A". The fifth transistor T5 has a gate connected to the sixth input terminal "SCAN", a first electrode connected to the fifth input terminal, and a second electrode connected to a second node "B". The sixth transistor T6 has a gate connected to the first node "A", a first electrode connected to the second node "B", and a second electrode connected to a positive electrode of the light emitting device. The seventh transistor T7 has a gate connected to the first node "A", a first electrode connected to the second node "B", and a second electrode connected to the seventh input terminal "VDD". The second capacitor "C2" is connected in parallel between the gate and the second electrode of the seventh transistor T7. The light emitting device has a negative electrode connected to the eighth input terminal "VSS".

In FIG. 6, the first transistor T1 through the third transistor T3 are set as N-type transistors, and the four transistor T4 through the seventh transistors T7 are set as P-type transistors, but the present embodiment is not limited thereto. Alternatively, the first transistor T1 through the third transistor T3 may be set as P-type transistors, and the four transistor T4 through the seventh transistors T7 may be set as N-type transistors.

In the display substrate according to the present embodiment, the conversion unit converts the voltage signal output from the source drive unit into the current signal and the pixel circuit is driven by the current signal. The technical solution according to the present embodiment makes the drive circuit have a high output accuracy and a low power consumption, and can also improve the uniformity of images displayed by the display panel and enlarge the dynamic range of the display panel.

Fifth Embodiment

Figure 7:
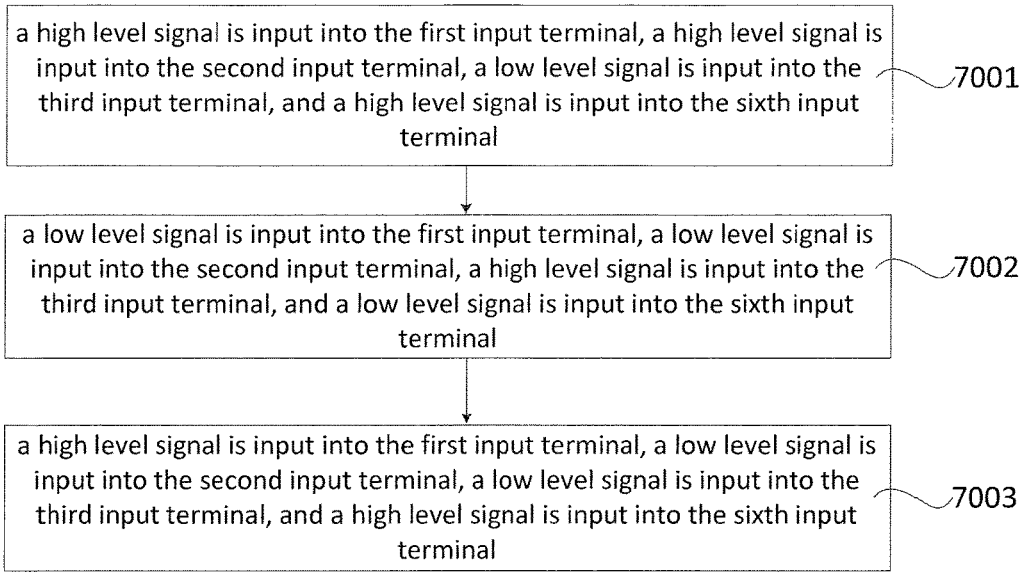
FIG. 7 is a flow chart showing a drive method of a display substrate according to a fifth embodiment of the present disclosure.
Figure 8:
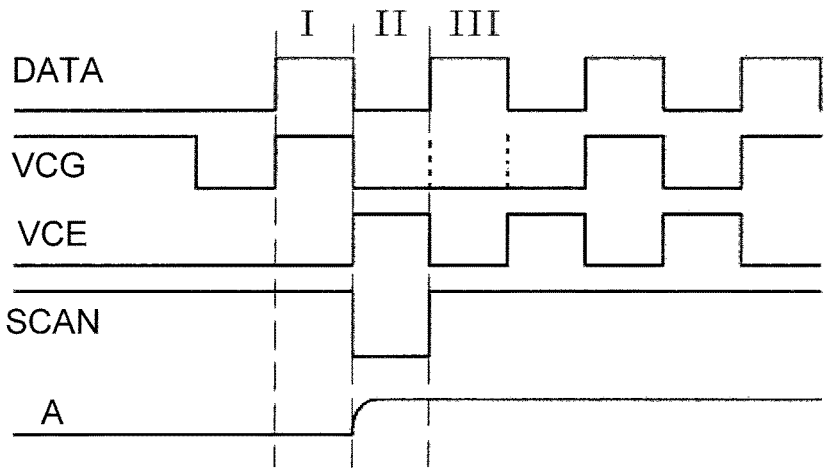
FIG. 8 is a timing chart of the operation of the display substrate corresponding to the drive method according to the fifth embodiment of the present disclosure.
Figure 9:
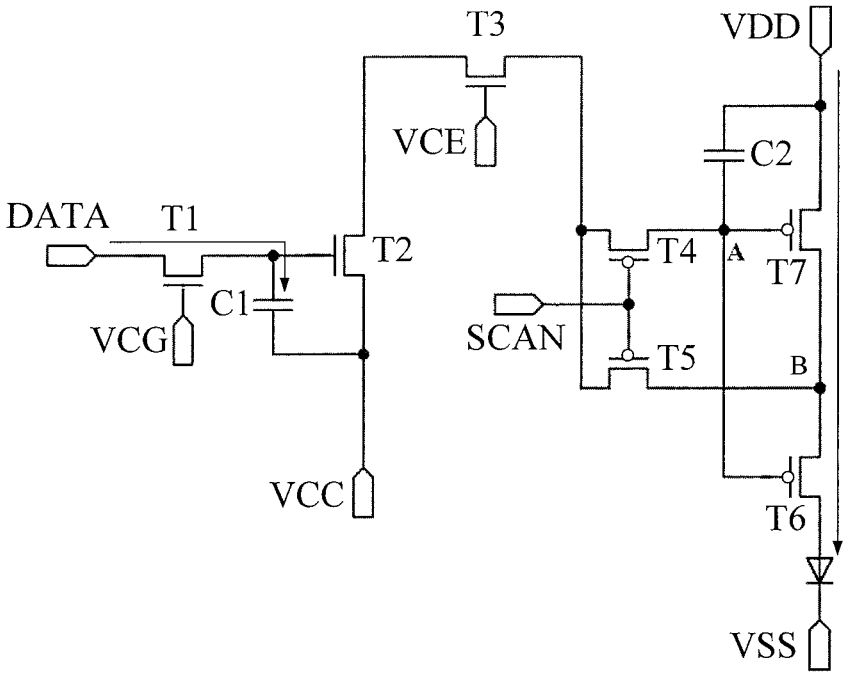
FIG. 9 is a schematic diagram showing a current path corresponding to phase 1 shown in FIG. 8.
Figure 10:
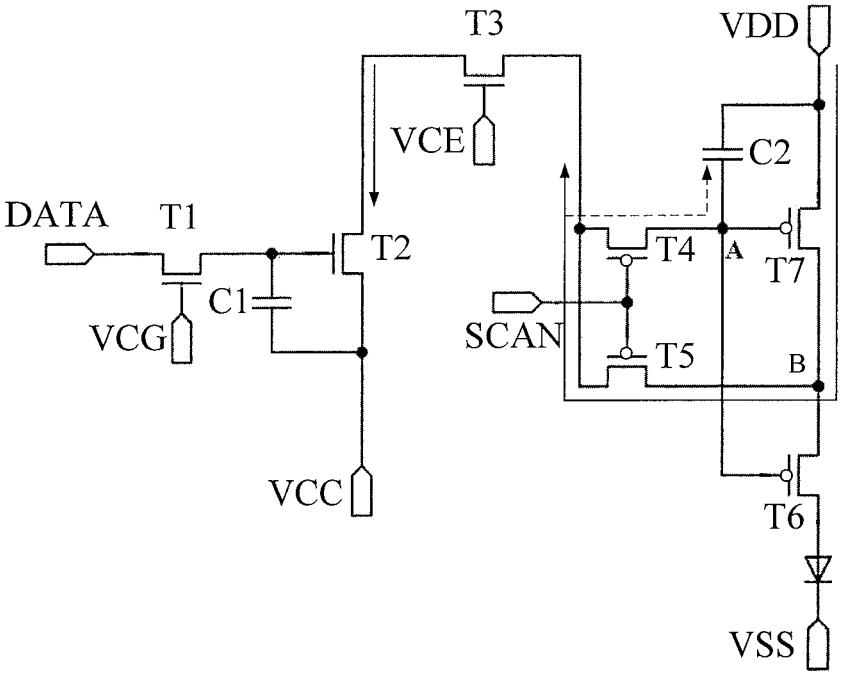
FIG. 10 is a schematic diagram showing a current path corresponding to phase 2 shown in FIG. 8.
Figure 11:
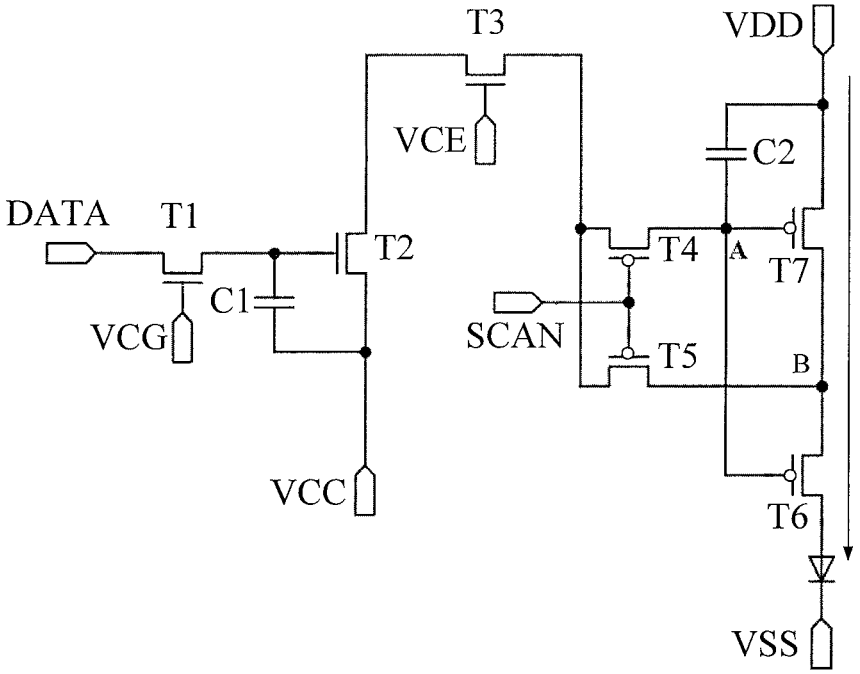
FIG. 11 is a schematic diagram showing a current path corresponding to phase 3 shown in FIG. 8.

FIG. 7 is a flow chart showing a drive method of a display substrate according to a fifth embodiment of the present disclosure, FIG. 8 is a timing chart of the operation of the display substrate corresponding to the drive method, and FIG. 9-FIG. 11 are schematic diagrams showing a current path corresponding to the first phase 1 through the third phase III shown in FIG. 8. The display substrate may comprise the display substrate according to the fourth embodiment, detailed description thereof is given as above, and thus detailed description thereof may be omitted for simplicity. Taking the display substrate according to the fourth embodiment as an example, a detailed description of the drive method of the display substrate according to the present embodiment will be given below with reference to FIG. 7-FIG. 11. As shown in FIG. 7, the drive method comprises steps 7001 through 7003 as follows.

At step 7001, a high level signal is input into the first input terminal, a high level signal is input into the second input terminal, a low level signal is input into the third input terminal, and a high level signal is input into the sixth input terminal. This step corresponds to the first phase I in the timing chart of the operations shown in FIG. 8.

In the present embodiment, the first phase I is a charging phase for the conversion unit. As shown in FIG. 8, the voltage signal input into the first input terminal "DATA" of the conversion unit is a high level signal, and the first drive signal input into the second input terminal "VCG" is also a high level signal. At this time, the first transistor T1 and the second transistor T2 are turned on, such that the charging of the first capacitor C1 is achieved. In this process, as shown in FIG. 9, the current flows from the first input terminal "DATA" of the conversion unit to the first capacitor C1, thereby accomplishing the charging of the first capacitor C1. In addition, at the first phase I, the second drive signal input into the third input terminal "VCE" of the conversion unit is a low level signal, such that the third transistor T3 is turned off; The scanning signal input into the sixth input terminal "SCAN" of the pixel circuit is a high level signal, such that the fourth transistor T4 and the fifth transistor T5 are both turned off. The potential at the first node A is at a low level. At this time, the sixth transistor T6 and the seventh transistor T7 remain the state of the previous frame of the display screen. In this process, as shown in FIG. 9, the current flows from the seventh input terminal "VDD" of the pixel unit to the light emitting device through the sixth transistor T6 and the seventh transistor T7.

At step 7002, a low level signal is input into the first input terminal, a low level signal is input into the second input terminal, a high level signal is input into the third input terminal, and a low level signal is input into the sixth input terminal. This step corresponds to the second phase II in the timing chart of the operations shown in FIG. 8.

In the present embodiment, the second phase II is a charging phase for the pixel circuit. As shown in FIG. 8, the voltage signal input into the first input terminal "DATA" of the conversion unit is a low level signal, and the first drive signal input into the second input terminal "VCG" is also a low level signal. At this time, the first transistor T1 is turned off and the second transistor T2 is turned on. In addition, the second drive signal input into the third input terminal "VCE" of the conversion unit is a high level signal, such that the third transistor T3 is turned on, and therefore the conversion unit outputs the current signal to the pixel circuit. The scanning signal input into the sixth input terminal "SCAN" of the pixel circuit is a low level signal, and therefore the fourth transistor T4 and the fifth transistor T5 are turned on. The sixth transistor T6 has a same gate voltage as the voltage at the first electrode of the sixth transistor T6, both of which are of a high level. The sixth transistor T6 is turned off, and the light emitting device does not emit light. At this time, the potential of the first node A is changed from the low level to the high level, and the charging of the second capacitor C2 is achieved by the first node A. In this process, as shown in FIG. 10, the current flows from the seventh input terminal "VDD" to the conversion unit through the seventh transistor T7 and the fifth transistor T5, while the second capacitor C2 is charged through the fourth transistor T4.

At step 7003, a high level signal is input into the first input terminal, a low level signal is input into the second input terminal, a low level signal is input into the third input terminal, and a high level signal is input into the sixth input terminal. This step corresponds to the third phase III in the timing chart of the operations shown in FIG. 8.

In the present embodiment, the third phase III is a light emitting phase for the pixel circuit. As shown in FIG. 8, the voltage signal input into the first input terminal "DATA" of the conversion unit is a high level signal, and the first drive signal input into the second input terminal "VCG" is a low level signal. At this time, the first transistor T1 and the second transistor T2 are turned off. In addition, the second drive signal input into the third input terminal "VCE" is a low level signal, and therefore the third transistor T3 is turned off. The scanning signal input into the sixth input terminal "SCAN" of the pixel circuit is a high level signal, and therefore the fourth transistor T4 and the fifth transistor T5 are turned off and the potential at the first node A is kept at a high level. At this time, the sixth transistor T6 has a same gate voltage as that of the seventh transistor T7, and the sixth transistor T6 and the seventh transistor T7 are turned on. As shown in FIG. 11, the current flows from the seventh input terminal "VDD" to the light emitting device of the pixel circuit through the sixth transistor T6 and the seventh transistor T7, and the light emitting device emits light.

In the present embodiment, the conversion unit converts the voltage signal output from the source drive unit into the current signal and the pixel circuit is driven by the current signal. The advantageous effects of the present disclosure will be demonstrated below by the experimental data generated from circuit simulation. Table 1 shows the differences between the currents output by the conversion unit at different data voltages and at different threshold voltages Vth, where the data voltage is the voltage input into the first input terminal "DATA" of the conversion unit, and the offsets reflect the differences between the currents at different threshold voltages and the current average:

TABLE 1 the differences between the currents output by the conversion unit at different data voltages and at different threshold voltages

| Data Voltage (V) | | Vth 0 V | Vth 0-0.1 V | Vth 0-0.2 V | Vth 0-0.3 V | Current Average (nA) |
|---|---|---|---|---|---|---|
| 1.5 | Current (nA) | 433.75 | 430.43 | 435.03 | 422.65 | 430.47 |
| | Offset (%) | −0.76 | 0.01 | −1.06 | 1.81 | |
| 2 | Current (nA) | 272.41 | 267.93 | 262.30 | 276.47 | 269.78 |
| | Offset (%) | −0.98 | 0.68 | 2.77 | −2.48 | |
| 2.25 | Current (nA) | 200.06 | 202.71 | 198.36 | 205.75 | 201.72 |
| | Offset (%) | 0.82 | −0.49 | 1.67 | −2.00 | |
| 2.5 | Current (nA) | 137.61 | 138.75 | 137.96 | 137.57 | 137.97 |
| | Offset (%) | 0.26 | −0.56 | 0.01 | 0.29 | |

TABLE 1-continued the differences between the currents output by the conversion unit at different data voltages and at different threshold voltages

| Data Voltage (V) | | Vth 0 V | Vth 0-0.1 V | Vth 0-0.2 V | Vth 0-0.3 V | Current Average (nA) |
|---|---|---|---|---|---|---|
| 2.75 | Current (nA) | 88.35 | 89.77 | 89.94 | 85.84 | 88.47 |
| | Offset (%) | 0.14 | −1.46 | −1.65 | 2.98 | |
| 3 | Current (nA) | 50.76 | 49.32 | 50.27 | 50.12 | 50.12 |
| | Offset (%) | −1.28 | 1.59 | −0.31 | 0.00 | |
| 3.25 | Current (nA) | 22.38 | 21.98 | 20.92 | 23.00 | 22.07 |
| | Offset (%) | −1.40 | 0.41 | 5.21 | −4.22 | |
| 3.5 | Current (nA) | 7.69 | 7.12 | 7.30 | 7.93 | 7.51 |
| | Offset (%) | −2.42 | 5.16 | 2.81 | −5.55 | |
| 3.75 | Current (nA) | 1.55 | 1.56 | 1.70 | 1.75 | 1.64 |
| | Offset (%) | 5.39 | 4.90 | −3.76 | −6.52 | |

From Table 1, with the assumption that the sixth transistor T6 has a same performance as that of the seventh transistor T7, in the technical solution according to the present embodiment, the offsets of the currents output by the conversion unit at different data voltages and different threshold voltages are small and a better compensation effect can be achieved.

In the present embodiment, by providing an example in which the first transistor T1 through the third transistor T3 are set as N-type transistors and the four transistor T4 through the seventh transistors T7 are set as P-type transistors, a description of the drive method of the display substrate is given, but the present embodiment is not limited thereto. In the case where the first transistor T1 through the third transistor T3 are set as P-type transistors and the four transistor T4 through the seventh transistors T7 are set as N-type transistors, when a drive method similar to that according to the fifth embodiment is used to drive the display substrate according to the present embodiment, at respective phases, at respective phases, the signals of high levels input at the second, third and sixth input terminals are changed to signals of low levels, and the signals of low levels input at the second, third and sixth input terminals are changed to signals of high levels.

In the drive method of the display substrate according to the present embodiment, the conversion unit converts the voltage signal output from the source drive unit into the current signal and the pixel circuit is driven by the current signal. The technical solution according to the present embodiment makes the drive circuit have a high output accuracy and a low power consumption, and can also improve the uniformity of images displayed by the display panel and increase the dynamic range of the display panel.

It is to be understood that the above embodiments are merely illustrative embodiments for the purpose of illustrating the principles of the present disclosure. However, the present disclosure is not limited thereto. It will be apparent to those skilled in the art that various variants and improvements can be made therein without departing from the spirit and scope of the present disclosure. The variants and improvements are also to be regarded as falling into the scope of the present disclosure.

We claim:

1. A drive method of a drive circuit comprising a conversion unit provided with a first input terminal, a second input terminal, a third input terminal, a fourth input terminal, and an output terminal, wherein the fourth input terminal is connected to a direct current power source, and wherein the output terminal is connected to a pixel circuit, the method comprising phase 1 through phase 3, wherein when the drive circuit is set in the first mode, the drive method comprises:

at phase 1, inputting a high level signal into the first input terminal, inputting a high level signal into the second input terminal, and inputting a low level signal into the third input terminal;

at phase 2, inputting a low level signal into the first input terminal, inputting a low level signal into the second input terminal, and inputting a high level signal into the third input terminal;

at phase 3, inputting a high level signal into the first input terminal, inputting a low level signal into the second input terminal, and inputting a low level signal into the third input terminal, when the drive circuit is set in the second mode, the drive method comprises:

at phase 1, inputting a high level signal into the first input terminal, inputting a low level signal into the second input terminal, and inputting a high level signal into the third input terminal, at phase 2, inputting a low level signal into the first input terminal, inputting a high level signal into the second input terminal, and inputting a low level signal into the third input terminal;

at phase 3, inputting a high level signal into the first input terminal, inputting a high level signal into the second input terminal, and inputting a high level signal into the third input terminal.

2. A drive method of a display substrate comprising a pixel circuit and a drive circuit, wherein the drive circuit comprises a conversion unit provided with a first input terminal, a second input terminal a third input terminal, a fourth input terminal, and an output terminal, wherein the fourth input terminal is connected to a direct current power source, the pixel circuit being provided with a fifth input terminal, a sixth input terminal, a seventh input terminal, an eighth input terminal, wherein the fifth input terminal is connected to the output terminal of the drive circuit, the seventh input terminal is configured to input a high level signal, and the eighth input terminal is configured to input a low level signal, the method comprising phase 1 through phase 3, wherein when the drive circuit is set in the first mode, the drive method comprises:

at phase 1, inputting a high level signal into the first input terminal, inputting a high level signal into the second input terminal, inputting a low level signal into the third input terminal, and inputting a high level signal into the sixth input terminal;

at phase 2, inputting a low level signal into the first input terminal, inputting a low level signal into the second input terminal, inputting a high level signal into the third input terminal, and inputting a low level signal into the sixth input terminal;

at phase 3, inputting a high level signal into the first input terminal, inputting a low level signal into the second input terminal, inputting a low level signal into the third input terminal, and inputting a high level signal into the sixth input terminal;

when the drive circuit is set in the second mode, the drive method comprises:

at phase 1, inputting a high level signal into the first input terminal, inputting a low level signal into the second input terminal, inputting a high level signal into the third input terminal, and inputting a low level signal into the sixth input terminal;

at phase 2, inputting a low level signal into the first input terminal, inputting a high level signal into the second input terminal, inputting a low level signal into the third input terminal, and inputting a high level signal into the sixth input terminal;

at phase 3, inputting a high level signal into the first input terminal, inputting a high level signal into the second input terminal, inputting a high level signal into the third input terminal, and inputting a low level signal into the sixth input terminal.

3. The drive method according to claim 1, wherein the conversion unit comprises a first transistor, a second transistor, a third transistor, and a first capacitor;

wherein the first transistor has a gate connected to the second input terminal, a first electrode connected to the first input terminal, and a second electrode connected to a gate of the second transistor;

wherein the second transistor has a first electrode connected to the fourth input terminal and a second electrode connected to a first electrode of the third transistor;

wherein the third transistor has a gate connected to the third input terminal and a second electrode connected to the output terminal;

wherein the first capacitor is connected in parallel between the gate and the first electrode of the second transistor, wherein a first electrode is one of source and drain of a transistor and a second electrode is the other of source and drain of the transistor.

4. The drive method according to claim 3, wherein the drive circuit further comprises a source drive unit connected to the first input terminal and configured to output a signal to the first input terminal.

5. The drive method according to claim 4, wherein the first transistor, the second transistor, and the third transistor are set in a first mode where the first transistor, the second transistor, and the third transistor are all set as N-type transistors, or a second mode where the first transistor, the second transistor, and the third transistor are all set as P-type transistors.

6. The drive method according to claim 2, wherein the pixel circuit comprises a fourth transistor, a fifth transistor, a sixth transistor, a seventh transistor, a second capacitor and a light emitting device;

wherein the fourth transistor has a gate connected to the sixth input terminal, a first electrode connected to the fifth input terminal, and a second electrode connected to a first node in the pixel circuit;

wherein the fifth transistor has a gate connected to the sixth input terminal, a first electrode connected to the fifth input terminal, and a second electrode connected to a second node in the pixel circuit;

wherein the sixth transistor has a gate connected to the first node, a first electrode connected to the second node, and a second electrode connected to a positive electrode of the light emitting device;

wherein the seventh transistor has a gate connected to the first node, a first electrode connected to the second node, and a second electrode connected to the seventh input terminal;

wherein the second capacitor is connected in parallel between the gate and the second electrode of the seventh transistor;

wherein the light emitting device has a negative electrode connected to the eighth input terminal, wherein a first electrode is one of source and drain of a transistor and a second electrode is the other of source and drain of the transistor.

7. The drive method according to claim 6, wherein the first transistor, the second transistor, the third transistor, the fourth transistor, the fifth transistor, the sixth transistor, and the seventh transistor are set in a first mode or a second mode, wherein in the first mode, the first transistor, the second transistor, and the third transistor are set as N-type transistors, and the fourth transistor, the fifth transistor, the sixth transistor, and the seventh transistor are all set as P-type transistors; and in the second mode, the first transistor, the second transistor, and the third transistor are set as P-type transistors, and the fourth transistor, the fifth transistor, the sixth transistor, and the seventh transistor are all set as N-type transistors.

8. The drive method according to claim 2, wherein the conversion unit is provided at the end of the fan-out structure of a display panel; or the conversion unit is provided between an output terminal of a source drive unit and a bonding area of the display panel.

* * * * *